US007592746B2

(12) United States Patent
McAlpine

(10) Patent No.: US 7,592,746 B2
(45) Date of Patent: Sep. 22, 2009

(54) PHOTOMULTIPLIER

(75) Inventor: Ronald M. McAlpine, Uxbridge (GB)

(73) Assignee: ET Enterprises Limited, Ruislip, Middlesex (GB)

( * ) Notice: Subject to any disclaimer, the term of this patent is extended or adjusted under 35 U.S.C. 154(b) by 415 days.

(21) Appl. No.: 11/067,844

(22) Filed: Feb. 28, 2005

(65) Prior Publication Data

US 2005/0253512 A1 Nov. 17, 2005

(30) Foreign Application Priority Data

Feb. 26, 2004 (GB) ..... 0404282.6

(51) Int. Cl.
*H01J 23/20* (2006.01)

(52) U.S. Cl. ..... 313/533; 313/542; 250/207

(58) Field of Classification Search ..... None
See application file for complete search history.

(56) References Cited

U.S. PATENT DOCUMENTS 3,753,023 A * 8/1973 Sommer ..... 313/103 R
5,077,504 A * 12/1991 Helvy ..... 313/103 R
5,196,690 A * 3/1993 Flesner et al. ..... 250/207
5,363,014 A 11/1994 Nakamura
5,689,152 A 11/1997 Boutot et al.
5,801,511 A * 9/1998 Kyushima et al. ..... 313/532
6,384,519 B1 5/2002 Beetz, Jr. et al.
6,989,632 B2 * 1/2006 Bach et al. ..... 313/533
7,109,463 B2 * 9/2006 Milshtein et al. ..... 250/207

FOREIGN PATENT DOCUMENTS

GB 1176910 1/1970
GB 2 113 000 A 7/1983

* cited by examiner

*Primary Examiner*—Ashok Patel
(74) *Attorney, Agent, or Firm*—Hodgson Russ LLP

(57) ABSTRACT

A photomultiplier (2) is disclosed having an element (16) for modifying the gain thereof either during manufacture (after the normal activation process) or in use, by changing the secondary electron emission characteristics of dynodes of the photomultiplier (2) and/or by modifying the electromagnetic field within the photomultiplier (2). The element (16) is made of a different material than the emissive surface of dynodes (8) of the photomultiplier (2). Methods of manufacturing a photomultiplier (2) and of tuning the gain of a photomultiplier (2) are also disclosed.

21 Claims, 6 Drawing Sheets

PHOTOMULTIPLIER

The present invention relates to a photomultiplier. In particular, the invention relates to a photomultiplier tube in which the gain, and therefore the overall sensitivity, may be tuned after the usual activation process.

Photomultiplier tubes are sealed, evacuated electronic devices which detect light, usually at very low levels, and yield a current output of useable magnitude. Photons incident on a photocathode liberate electrons by the photoelectric effect. The liberated electrons are focussed and accelerated to impact on the first of a cascade of dynodes held at a more positive electrical potential than the photocathode. The second and subsequent dynodes are held at progressively more positive potentials. Each dynode is provided, during a process known as activation, with a surface that releases a number of secondary electrons per incident electron, the ratio of secondary to incident electrons (gain) increases as the electric potential between the dynodes increases. The secondary electron amplification process is repeated at each dynode stage, such that the number of electrons incident on a final collector held at a still more positive potential, the anode, is significantly greater than the number of electrons emitted by the photocathode, i.e. there is gain, often up to $10^6$ or more. The gain of the device is an important parameter in practical applications, and it is often desirable to have a photomultiplier with a predetermined gain.

There are a number of different procedures for providing the secondary emissive surface. One procedure, outlined in GB 2 113 000, is to provide a wire, coated with antimony at an equipotential line between dynodes. This material, when combined with an alkali metal forms an appropriate emissive surface on the dynode. The wire is heated through radio-frequency induction which causes the evaporation of the antimony, and its deposition on the facing dynodes, where it provides one component of an emissive surface. The other main component of the emissive surface, an alkali metal, is fired separately. The activation process is then completed and the photomultiplier tube is made ready for use.

However, even when using such procedures, it is common that each individual device of a specific type will have a gain value (and so overall sensitivity) for a specific applied overall voltage which varies significantly from the mean value for photomultiplier tubes of that type, at that specific applied overall voltage. This variation in gain is due to variations in the activation process and ultimately to tolerance variations of the mechanical size and fit of the component parts. Typically the variation in gain is of a factor in the order of 100 to 1, meaning that the gain of one photomultiplier may be one hundred times the gain of another photomultiplier manufactured using the same process, even in the same batch.

The variation in gain is often normalised by applying appropriate different overall voltages to each device, but this is undesirable in situations in which a user intends to operate more than one photomultiplier from a single power supply. Such an approach may further be detrimental to other aspects of the performance of the photomultiplier, e.g. time response.

Another known method to normalise gain is to maintain the overall applied voltage but to vary individual elements of the voltage divider network so as to vary the potential applied to a particular dynode within the limits of the potentials applied to the dynodes preceding and following it. In this way the gains of the various dynode stages may be altered. However, in certain practical applications, this approach is not satisfactory, since this variation of the interdynode voltages may also be detrimental to the performance of the photomultiplier in other respects.

The methods of manufacture currently available do not facilitate changing the gain of the photomultiplier after activation. Furthermore, these methods are disadvantageous for the reasons outlined above, and because they require external adjustment of the voltages applied to each device by the user.

It is therefore an aim of one aspect of the invention to provide a photomultiplier having a pre-tuned gain at a particular overall voltage after the end of the activation process. Further aims of the invention are to provide methods for the manufacture of such photomultipliers (for example so that batches of photomultipliers may be manufactured having substantially identical gains) and a method of tuning a photomultiplier after manufacture.

In accordance with a first aspect of the invention, there is provided a photomultiplier comprising a photocathode, a plurality of dynodes, the dynodes having an emissive surface of a first material and an anode, the photomultiplier further comprising a gain modifying element of a second material disposed between successive dynodes, the second material being different from the first material. Preferably the element is disposed between two dynodes.

Alternatively the gain modifying element may be disposed between the photocathode and the first dynode, or anywhere else within the photomultiplier. The provision of the gain modifying element within the photomultiplier tube may have the advantage of enabling the modification of the gain of the dynode without adjusting the overall potential of the photomultiplier or the interdynode potentials.

Furthermore, the gain can be reduced to a stable value, through appropriate choice of material coating of the wire. It is undesirable to use any of the materials which make up the original secondary emissive surface, as this material would chemically react with the surface over time, leading to unstable gain behaviour.

Preferably, the gain modifying element is a gain reducing element. Therefore, this invention provides a way to reduce the gain of the photomultiplier and involves the realisation that reduction of gain can be of use in standardising the gain Preferably, the gain modifying element is adapted to deposit a second material on one or more dynodes, thereby altering the secondary electron emission characteristics of those dynodes, preferably after the usual activation process. Therefore this invention involves the realisation that the emissive surface may be modified after activation, advantageously by an internal element, to bring the gain closer to a desired value. The change in gain may be permanent or temporary.

By secondary electron emission characteristics of a dynode, we mean primarily the ratio of the number of secondary electrons emitted by that dynode over the number of electrons incident on the dynode, and statements relating to the deterioration or improvement of the electron emission characteristics of a dynode mean primarily a decrease or an increase, respectively, in that ratio.

For example, the gain modifying element may be coated or formed from the material to be deposited, which is preferably unreactive in order to reduce the likelihood of the material reacting, for example, with the material of the electrodes, and thereby to increase the stability of the gain. The gain modifying element is, advantageously, internal to the photomultiplier.

The second material may be one, such as a non-alkali metal, for example manganese or aluminium, which causes deterioration of the secondary electron emission characteritics of the dynode.

The first material may be either a combination of antimony with an alkali metal such as caesium; or beryllium oxide or a combination.

Coating the emissive surface of a dynode with a non-emissive material, such as a non-alkali metal is counter-intuitive, but effective, way to control gain.

Alternatively or additionally, the emissive surface of the dynode may comprise a mixture and/or alloy of antimony, an alkali metal, and/or beryllium oxide.

Preferably, the gain modifying element comprises a wire, preferably located along a line of equipotential within the dynode cascade (i.e. between dynodes) of the photomultiplier.

In this way, the electromagnetic effects of the presence of the wire may be minimised by applying to it the potential which the equipotential line would have in the absence of the wire. Preferably, the wire is as thin as possible in order also to minimise its importance as a physical obstruction. Previously, wires (known as "focusing wires" have been placed between dynodes in order to provide an electromagnetic effect (such as increasing the time response of the photomultiplier). In order to provide (rather than minimise) such an effect such wires have not been placed on equipotential lines, nor had their potential tied to a dynode.

Preferably, the wire is located along a line which, in the absence of the wire, would have the same potential as one of the dynodes and the wire is electrically connected to that dynode. In this way, the wire is maintained at the same potential as the dynode.

In such cases, the electrical connection between the wire and the dynode is preferably wholly within an evacuated chamber of the photomultiplier. In this way, the number of pins passing through the wall of the chamber may be minimised, potentially resulting in greater ease of construction.

The photomultiplier preferably comprises more than two (for example between 6 and 14) dynodes.

The gain modifying element is preferably located towards the middle of the dynode cascade. For example, in a photomultiplier comprising ten dynodes, the gain modifying element may preferably be located between the fourth and fifth dynodes, the fifth and sixth dynodes or the sixth and seventh dynodes.

The gain modifying element may be electrically connected to a connector which preferably passes though the chamber of the photomultiplier, for example an electrically isolated pin. The chamber preferably is a vacuum sealed envelope. In a first embodiment, the gain modifying element is connected to a dynode at one end and electrically connected to one external connector at another. Alternatively in a second embodiment, the gain modifying element is electrically connected to two external connectors.

In the first embodiment, the external connector provides a way of activating the gain modifying element. The gain modifying element may thereby be connected to a current source and a current, conveniently of more than 1 A, preferably substantially 2 A, passed through it. This will heat the element sufficiently for the second material to be deposited on the emissive surface.

In the second embodiment, the two external connectors allow the gain modifying element to be held at a voltage other than the voltage of a dynode. Providing an element at an alternate voltage, preferably a more positive voltage, may attract electrons to the element, rather than allowing them to travel through the photomultiplier, thereby lowering the gain of the photomultiplier.

These features may also be provided independently. Therefore, in a second aspect of this invention, there is provided a photomultiplier comprising a chamber, a photocathode, a plurality of dynodes, and an anode, the photomultiplier further comprising a gain modifying element disposed between successive dynodes and being electrically connected to a connector external to the chamber. Preferably the chamber comprises a vacuum sealed envelope. Preferably the chamber houses the photocathode the dynodes and the anode.

The gain modifying element may be electrically connected to a second connector external to the chamber.

In accordance with a third aspect of the invention, there is provided a batch of photomultipliers each comprising a plurality of dynodes having an emissive surface formed of a mixture of materials the proportions of materials in the mixture being chosen such that each photomultiplier in the batch has substantially the same intrinsic gain.

In this context the term "batch" means a group of photomultipliers manufactured according to substantially the same process on substantially the same equipment, preferably within a time window such as a day, a week or a fortnight.

Conveniently the intrinsic gain of the photomultipliers is substantially the same to within a factor of 2 to 1, conveniently 1.5 to 1, preferably 1.25 to 1 in a preferred embodiment 1.2 to 1, even 1.1 to 1.

In accordance with a fourth aspect of the invention, there is provided a photomultiplier comprising a gain modifying element (preferably in the form of a wire) between dynodes of the photomultiplier which is operable to be actuated after activation of the photomultiplier. Preferably the gain modifying element is located along a line of equipotential of the photomultiplier.

material to be deposited (in a controllable manner) on a dynode of the The material may be caused to be deposited by actuating the gain modifying element after activation of the photomultiplier.

Preferably the gain modifying element is actuated by heating, preferably by passing a current through the gain modifying element. Passing a current may comprise pulsing the current such that the element is heated and the material is deposited, but the dynodes and, preferably, the rest of the photomultiplier remain relatively cool. This lessens the risk of decomposition of the original emissive surface of the dynodes.

In accordance with a fifth aspect of the invention, there is provided a method of manufacturing a photomultiplier, comprising vaporising a material and selectively depositing the vaporised material on one or more dynodes to adjust the gain of those dynode, the material being different from the materials making up an emissive surface of the dynodes. Preferably the material is vaporised within an envelope of the photomultiplier. The second material may be a non-alkali metal, preferably manganese or aluminium. Preferably the deposition of the material reduces the gain of the photomultiplier.

In accordance with a sixth aspect of the invention, there is provided a method of altering the gain of a photomultiplier in use, comprising actuating a gain modifying element located between dynodes of the photomultiplier.

Preferably the gain modifying element reduces the gain of the photomultipler when actuated.

Actuation of the gain modifying element preferably modifies the electromagnetic field between dynodes of the photomultiplier when in use. A potential applied to the gain modifying element may be such that electrons emitted by a a dynode of the photomultiplier do not reach a subsequent dynode of the photomultiplier.

Photomultiplier tubes manufactured or adapted to be used as outlined above are also provided in accordance with aspects of this invention.

The preferred features of any of the aspects of the invention outlined above may be combined with any other of the aspects to provide an improved photomultiplier tube or method of manufacture or use of such a tube.

Embodiments of the invention will now be described in more detail with reference to the accompanying drawings, in which.

Figure 1:
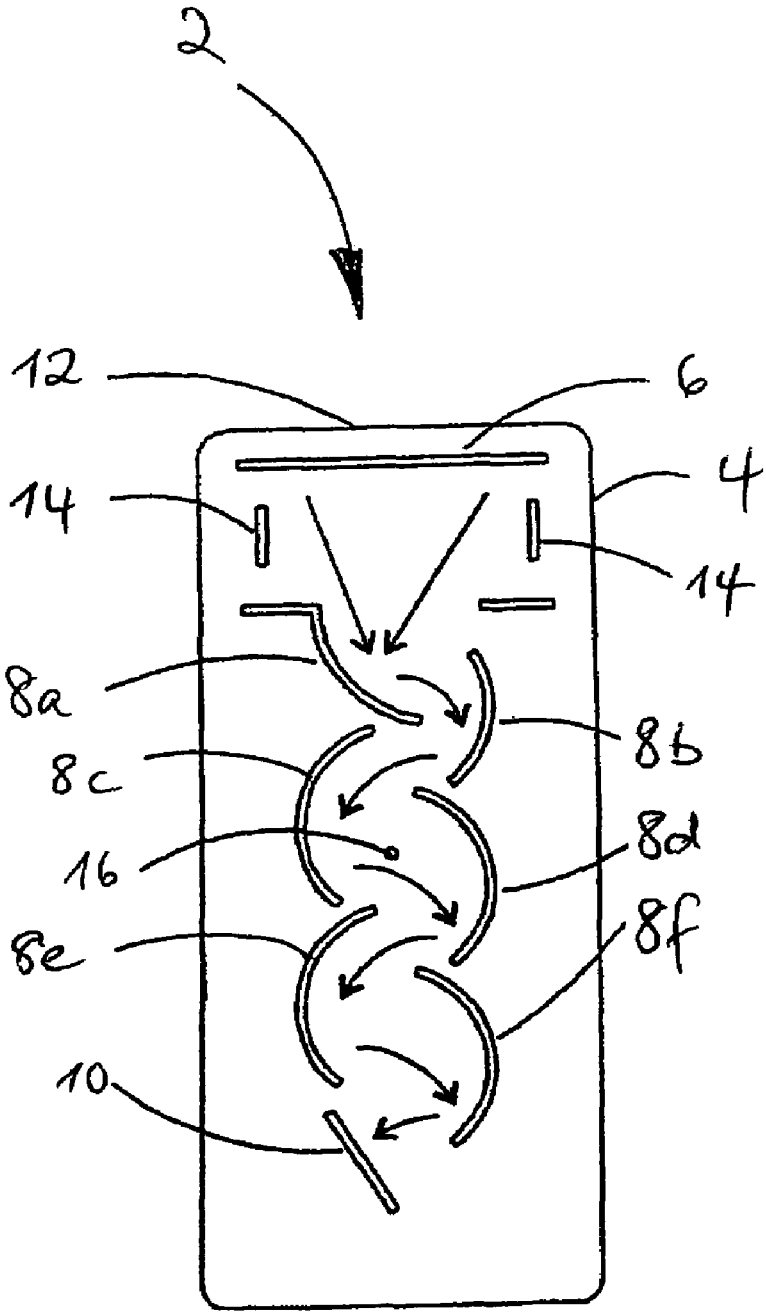
FIG. 1 is a simplified schematic view of a photomultiplier tube embodying the invention.

FIG. 1 shows, in a simplified schematic form, a linear-focus type photomultiplier having a series of staggered opposing dynodes of part-cylindrical form. The photomultiplier 2 comprises an evacuated chamber 4, commonly formed of glass, which houses a photocathode 6, a plurality (for example, between six and fourteen) dynodes 8 and an anode 10. Light enters the chamber 4 through a window 12, also commonly formed of glass, and is incident on the photocathode 6.

Further electrodes 14 are also included (at least in the photomultiplier shown in FIG. 1), most commonly between the photocathode 6 and first dynode 8*a* and termed focusing electrodes. The focusing electrodes 14 aid electron collection and/or timing between the photocathode 6 and the first dynode stage.

As with known photomultipliers, following assembly, the photomultiplier is activated by evacuating the chamber 4 and coating (by deposition of alkali metal vapours) the photocathode 6 and the dynodes 8 with a material which emits photoelectrons or secondary electrons, for example an alkali metal in combination with antimony BeO or other secondary emissive material. The material combination is selected depending upon the frequency of radiation to which the photomultiplier is intended to be sensitive. In order to provide long-term relatively static gain at each stage, the material is also selected to minimise the likelihood that it might react with the substrate of the electrodes and cause the gain to vary. The tube is then sealed and a burn-in or ageing step is usually taken in which operating potentials are applied to the electrodes of the photomultiplier in order to allow any initial variations in gain to settle.

Figure 2:
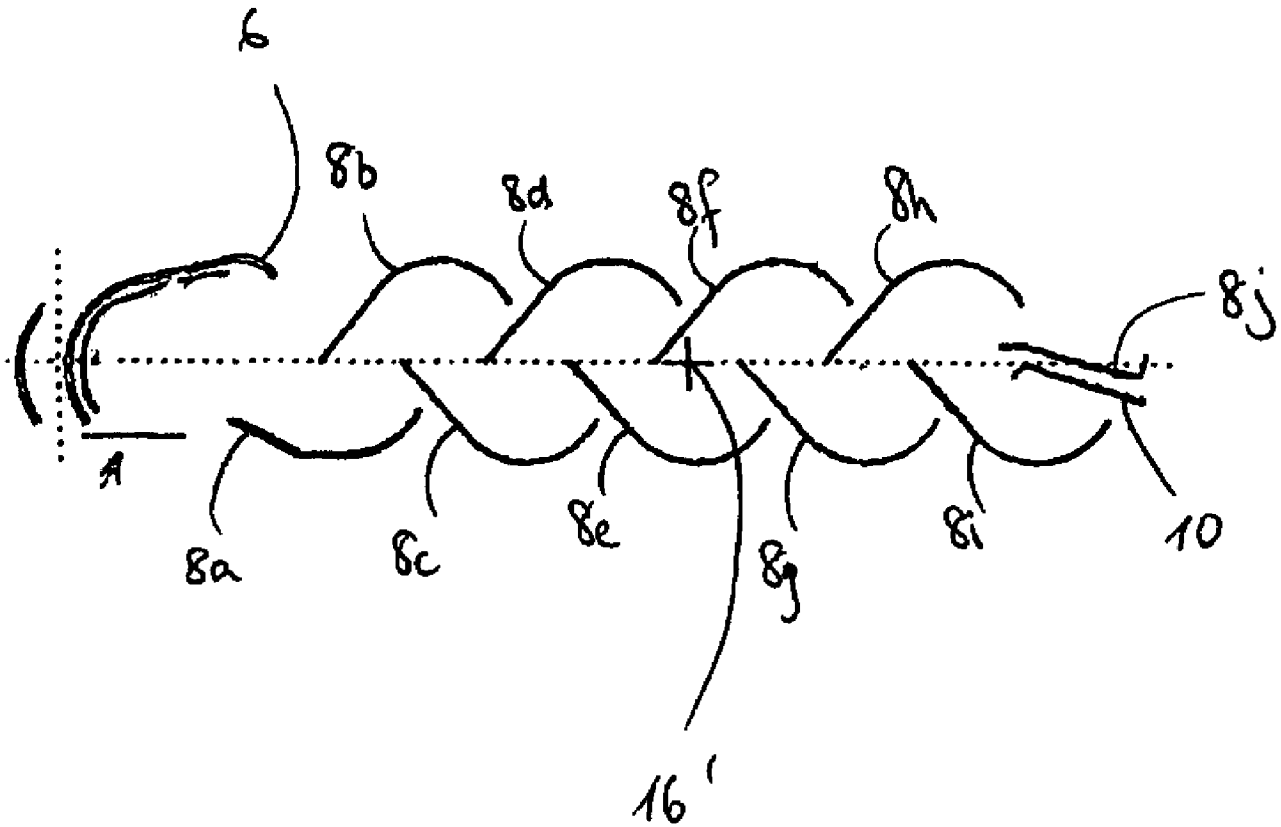
FIG. 2 is a simplified view of a further photomultiplier tube embodying the invention.

FIG. 2 shows the location of the electrodes in a particular embodiment of a photomultiplier having ten dynodes 8*a* to 8*j*. In this case, the chamber 4 is not shown.

The photon input to the photocathode gives rise to photoelectron emission. The electrons emitted are attracted to a first dynode 8*a* which is held at a positive voltage with respect to the photocathode. As indicated above, the first dynode 8*a*, has a prepared surface that will in turn give rise to secondary electron emission due to the impact of the incident primary photoelectrons. More output secondary electrons can be produced than input primaries, so gain occurs. This gain is dependent on the surface coating of the dynode (which may comprise, for example, antimony and an alkali metal, e.g. caesium, or BeO or both; or other secondary emissive material or combination), the impact energy of the input electrons (which is a function of the applied voltage), and the incident angle of the input electrons.

Each of a cascade of further dynodes 8*b* to 8*f* (in FIG. 1) or 8*j* (in FIG. 2), having similarly prepared surfaces, and each held at progressively higher (positive with respect to the cathode) voltages, in turn receives electrons from its predecessor and emits further secondary electrons, with gain occurring at each dynode stage. After a number of these dynode stages (in this embodiment, ten), the output secondary electrons from the last dynode 8*j* are collected by the anode 10, which provides the photomultiplier output signal (current). The overall gain produced by the dynode cascades of typical photomultipliers may be up to $10^6$ or more.

In the embodiment shown in FIG. 2, the photocathode 6 is held at 0 v, the first dynode 8*a* is held at +150 v and subsequent dynodes are held 75 v more positive than the preceding dynode (i.e. the second dynode 8*b* is at +225 v, the third dynode 8*c* is at +300 v, etc) and the anode 10 is held 75 v more positive than the final dynode 8*j* (i.e. +900 v).

Electrically isolated pins (not shown) through the chamber wall provide electrical connection between external equipment, such as a high voltage power supply and voltage divider network (not shown), and the various electrodes within.

The photomultiplier 2 further comprises, or is connected to, a voltage divider network (not shown) comprising, for example, a series of high value resistors. Tappings of the voltage divider network provide the progressively higher (positive) voltages to the photocathode 6, the cascade of dynodes 8, and the anode 10 of the photomultiplier 2.

The photomultiplier shown in FIG. 1 further comprises a gain modifying element in the form of a wire 16 disposed between two dynodes 8*c*, 8*d*. The wire 16 extends in a direction parallel to the surfaces of the part-cylindrical dynodes 8*c*, 8*d*, which is a line of equipotential of the photomultiplier. The photomultiplier shown in FIG. 2 also comprises a gain modifying element in the form of a wire in the location denoted 16', between dynodes 8*e* and 8*f*.

One or more of the electrically isolated pins (not shown) may be electrically connected to either one, or both, ends of the gain modifying element.

Figure 3:
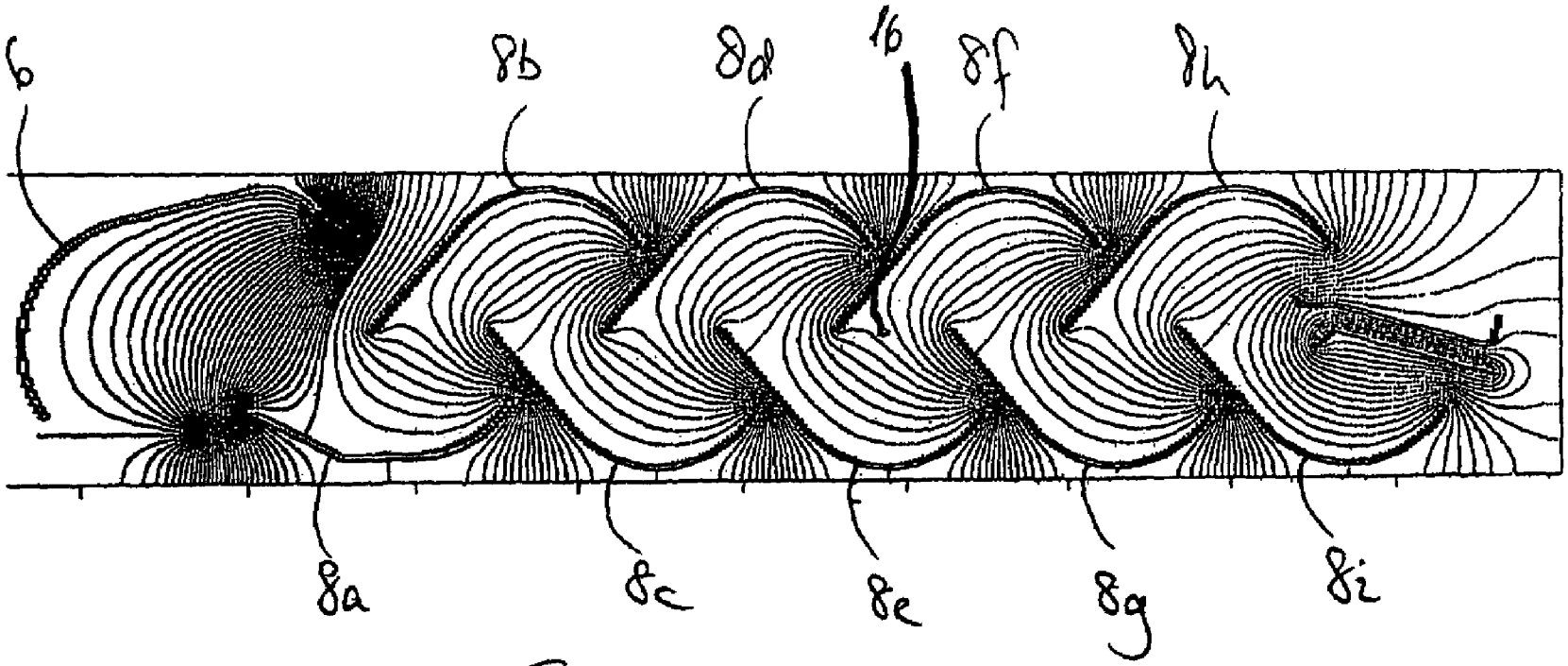
FIG. 3 shows the electrodes of the photomultiplier and the locations of equipotentials when the electrodes are held at usual operating potentials.

FIG. 3 shows the photocathode 6, the dynodes 8, the anode 10 and the wire 16 of the photomultiplier shown in FIG. 2. Also shown are lines indicating the locations of surfaces of equipotential between the electrodes when they are held at their operating potentials. As stated above, the wire 16 is aligned such that it is parallel to the surfaces of the part cylindrical dynodes. It thus occupies a straight line within a plane of equipotential (when the photomultiplier is in use). In this position, by applying the appropriate potential to the wire (in fact in this embodiment, the same potential as dynode 8*f*), it is possible to hold the wire at the same potential as the electric field would be at the wire's position were the wire absent. By such an arrangement the wire has little or no modifying effect on the electric field pattern when the photomultiplier is in use. This is illustrated by the symmetry of the distribution of equipotentials between the fifth and sixth dynodes 8*e*, 8*f* (where the wire 16 is located) and, for example, between the third and fourth dynodes 8*c*, 8*d* and between the eighth and ninth dynodes 8*g*, 8*h*. Moreover, by using a wire which is thin in comparison with the distance between dynodes it is possible to reduce the importance of the wire as a physical obstruction to electrons passing between dynodes.

In a first embodiment, in which the gain of an individual dynode stage or stages is permanently modified during manufacture of the photomultiplier, the wire 16 is coated with a material, preferably a metal, and is actuated by heating after the usual activation stage of the manufacture of the photomultiplier (described above) such that the metal is deposited on the surface of one or more dynodes (e.g. 8*e* and 8*f*). The material (for example, a non-alkali metal such as manganese or aluminium) is selected for the property that it reduces the secondary emission characteristics of the surface of the dynode or dynodes onto which it is deposited, thereby reducing the gain at that dynode or dynodes to a desired level.

In a second embodiment, structurally similar to the first and in which the gain of an individual dynode stage or stages is again permanently modified during manufacture of the photomultiplier, the wire 16 is again coated with a material and heated at a stage after the usual activation stage of the manufacture of the photomultiplier such that the metal is deposited on the surface of one or more dynodes (e.g. 8*e* and 8*f*). However, in this embodiment, the metal (for example, an alkali metal) is selected for the property that it increases the secondary emission characteristics of the surface of the dynode or dynodes onto which it is deposited, thereby increasing the gain at that dynode or dynodes to a desired level.

The modification of secondary emission characteristics in the above two embodiments, and hence the placement of the wire or wires, is carried out at a dynode stage part way along the cascade of dynodes (for example between the fifth and sixth dynodes 8*e*, 8*f* of a photomultiplier having ten dynodes, such as that shown, between the n-5 and n-4 dynode of a photomultiplier having n dynodes, where n is, for example, 10, 11, 12, 13 or 14), rather than in the early dynode stages, close to the photocathode 6 (which might result in increased noise-in-signal), or in the end stages, close to the anode 10 (which might be detrimental to pulse height linearity).

The gain modifying element in both of the above embodiments is electrically connected at one end to an adjacent dynode and at its other end to one of the electrically isolated pins. It is thus held at the voltage of the adjacent dynode. To activate the gain modifying element, the pin to which it is electrically connected is connected to a current source such that a current of substantially 2 amps flows in the gain modifying element. This causes the gain modifying element to heat up and emit gain modifying material. The voltage of the current source is controlled so that the current through the gain modifying element is pulsed. The current passed in a pulse is sufficient to heat up the gain modifying element, but insufficient to heat other elements of the photomultiplier. This lessens the risk of a decomposition of the original emissive surface of a dynode that would be detrimental to the stability of its gain. The number of pulses is controlled such that a desired quantity of material is deposited on the emissive surface. The gain (or the sensitivity) of the photomultiplier may be measured between pulses.

During operation of the photomultiplier 2, the pattern of electric field intensity between electrodes of a photomultiplier tube is important for the efficient transfer of electrons from one dynode to the next. Any modification of the pattern of those fields from the optimum could bring about a corresponding disruption of the electrons' paths from one dynode to the next. In order to prevent the insertion of wire 16 within the multiplier structure causing a significant change in the electric field intensity pattern between the dynodes 8, since the wire will still be present when the photomultiplier is ultimately in use, the potential of the wire 16 is controlled during operation of the photomultiplier.

Figure 4:
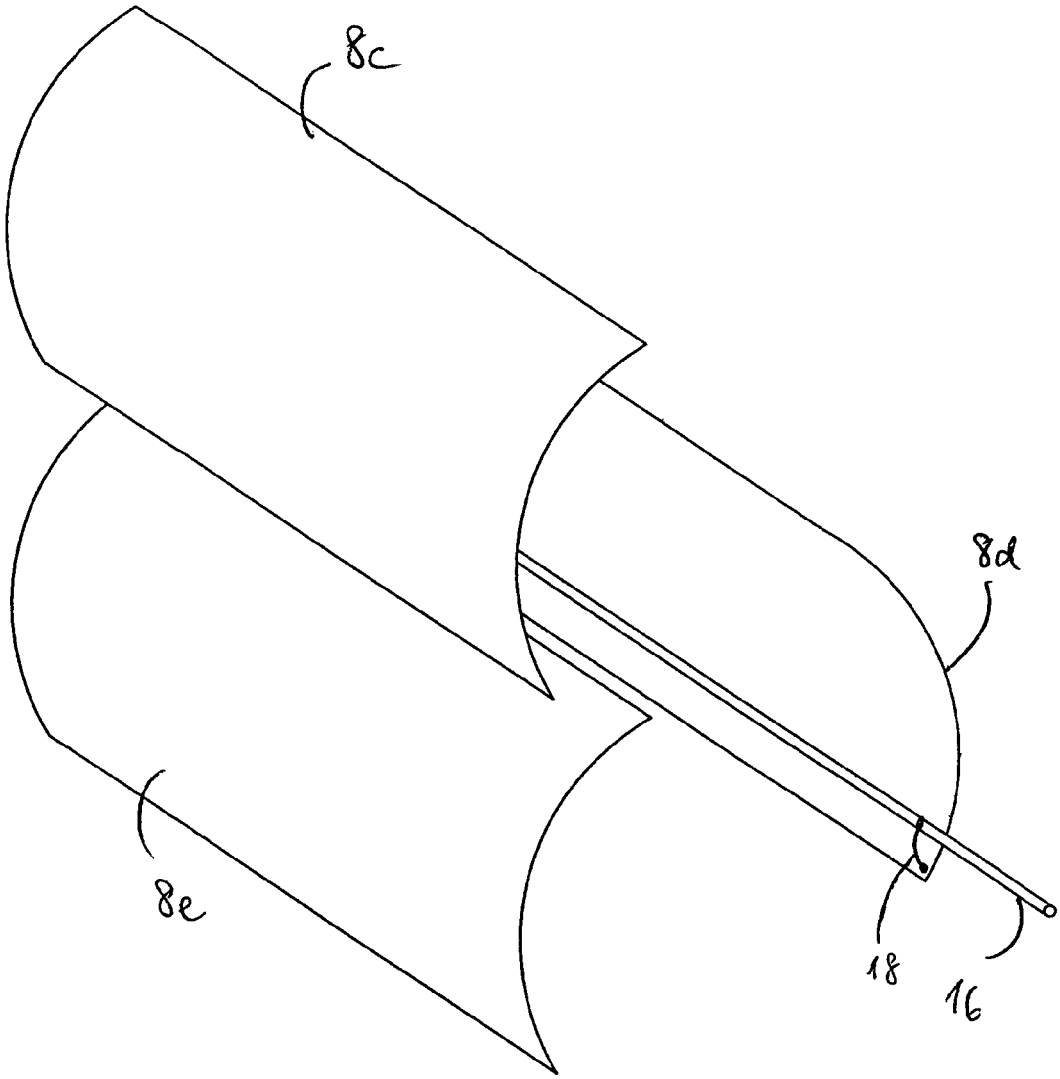
FIG. 4 is a detail in perspective of a photomultiplier embodying the invention.

At most points in the region of the dynodes when the photomultiplier is in use, the potential is the result of the effects of at:least three dynodes at different potentials. In a particular embodiment, the wire is located along an equipotential at which the potential is the same as that of one of the three closest dynodes. In such a position it is well-placed to deposit the metal onto at least one of them. In this embodiment, a detail of which is shown in FIG. 4, the wire 16 is connected by a connection 18 to the dynode 8*d* having the same potential as the position of the wire 16 would have in the absence thereof, so that the wire has the above-described lack of modifying effect on the electric field pattern when the photomultiplier is in use. In addition in a particular embodiment, the electrical connection to the wire (for passing a current therethrough when gain tuning is to be performed) is made internally in common with the connection to the relevant dynode. The other end of the wire passes through a wall of the chamber 4.

In embodiments in which the wire 16 is not connected to a dynode 8, the wire 16 should at no time during operation of the photomultiplier be left completely unconnected (or "floating") as such a condition would cause erratic operation of the photomultiplier. Instead, the wire is attached to a tapping of the voltage divider network (not shown) which powers the photomultiplier, which tapping is at the desired potential for the wire.

The embodiment described above is manufactured in a known manner, with the additional step of providing one or more gain-modifying wires 16 in one or more positions as described above. The procedure for the gain tuning of a photomultiplier comprises the passing of a current through the gain-modifying wire (or wires) to induce the deposition of the metal coated thereon onto the dynode (or dynodes). The necessary duration and current are dependent upon the desired modification of gain, the materials being used and the physical characteristics of the photomultiplier and may be determined experimentally.

The gain tuning step may be taken while the photomultiplier tube is attached to a vacuum processing station by which it is evacuated, after the usual activation process. However, in a preferred embodiment, the manufacturing process includes a "burn in" or "aging" step, and the gain tuning step is performed after this process. In a particular embodiment, the burn in step is repeated after the gain tuning procedure and/or the photomultiplier is tested.

In further examples, the heating of the gain-modifying wire (or wires) 16 is achieved by alternative methods, such as RF heating (also known as eddy current heating B "ECH"). In operation of such photomultipliers, the gain modifying wire is again not left floating; its potential is assured by one of the methods discussed above.

In yet further embodiments (in which a gain modifying wire 16 is not directly electrically connected to a dynode), the gain-modifying wire 16 may be used additionally or alternatively to modify the gain of the photomultiplier during operation thereof, without modifying the overall potential of the photomultiplier, or its interdynode potentials. This may be achieved by using deliberately modifying the electric field patterns between the dynodes during operation of the photomultiplier, essentially by passing a current through the gain-modifying wire (or wires) 16. Since the electric field between two dynodes controls the flow of electrons from one to the next, deliberate modification of that field may be used to reduce the number of electrons emitted by one dynode arriving at the next dynode.

Figure 5:
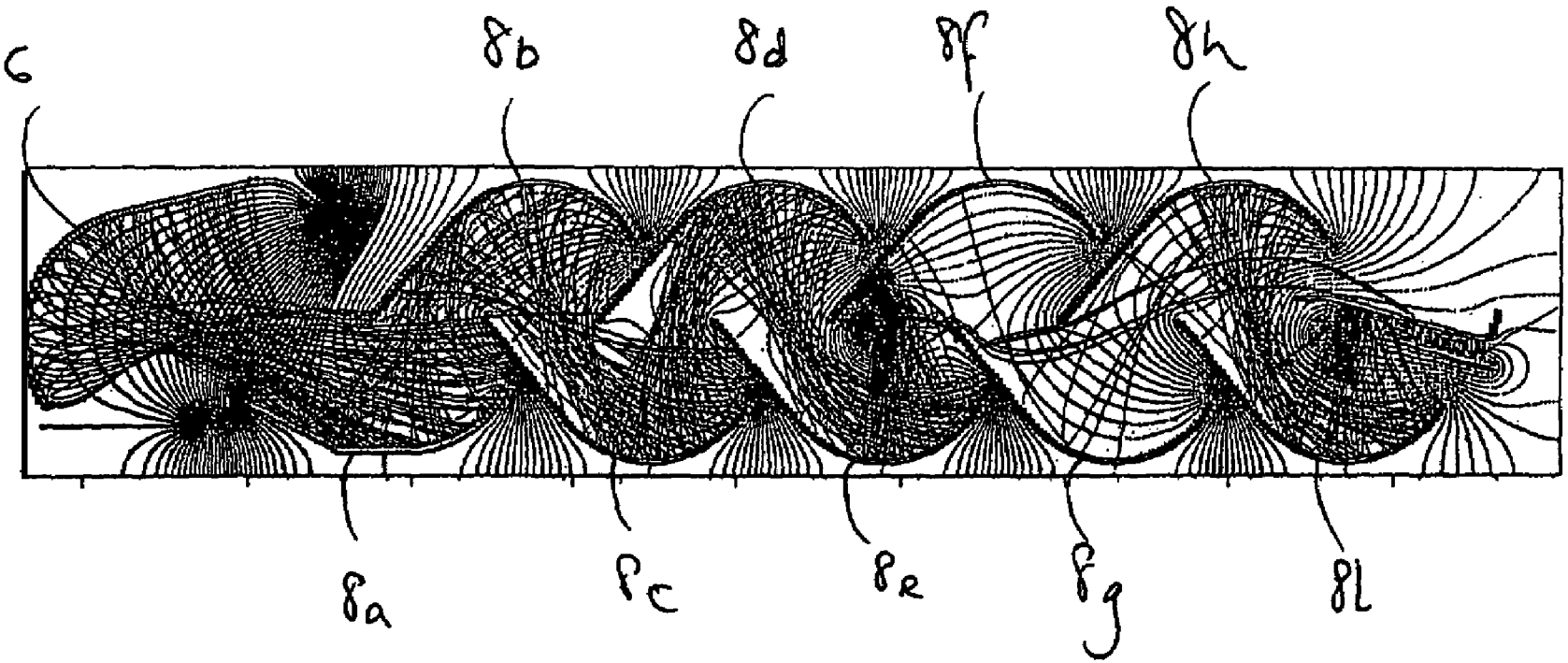
FIG. 5 shows the electrodes of the photomultiplier and the locations of equipotentials and predicted electron paths when a gain modifying element is positive in relation to surrounding dynodes.

FIG. 5 shows the main electrodes of the photomultiplier shown in FIGS. 2 and 3 and the equipotentials with the electrodes held at the potentials set out above. In this case, however, instead of +525V (the potential of the adjacent dynode 8*f*) the wire 16 is held at +650V, i.e. it is positive compared with the dynodes surrounding it. Statistically predicted electron paths are also shown in this Figure. As may be seen, by application of a suitable potential, the gain-modifying wire 16 may be used to reduce the gain of the photomultiplier to near zero (by applying a large positive potential, whereupon the gain-modifying wire will preemptively collect the electrons passing it). In this way, the activity of the photomultiplier tube is effectively "switched off" at required times, or, more commonly, is repeatedly switched "off-and-on" at some, often rapid, desired rate.

Figure 6:
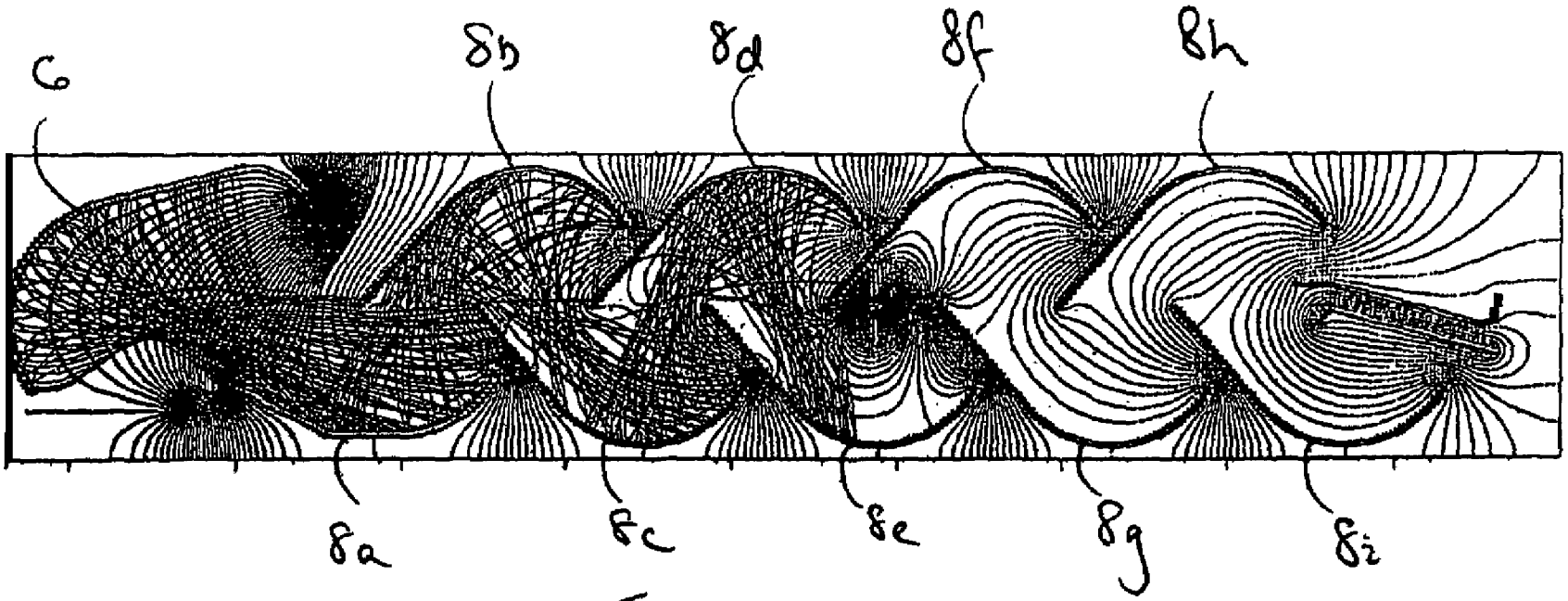
FIG. 6 shows the electrodes of the photomultiplier and the locations of equipotentials and predicted electron paths when a gain modifying element is negative in relation to surrounding dynodes.

FIG. 6 shows a similar arrangement in which the wire 16 is held at 0V (that is the same potential as the cathode). Since the wire is then significantly negative compared with the surrounding dynodes (e.g. 8*e*, 8*f*), it modifies the electric field between the dynodes such that electrons emitted by the fifth dynode 8*e* do not reach the sixth dynode 8*f*, but instead return to the fifth or fourth dynodes 8*e*, 8*d*.

In embodiments in which the primary or sole purpose of the gain-modifying wire is the gating of the photomultiplier in this way, the wire 16, and hence the modification of the electric field pattern, is carried out at a dynode stage closer to the beginning of the cascade of dynodes, since at such locations, the cloud of electrons is smaller than at later dynode stages, where it is larger (due to the gain of the preceding dynode stages) and where the larger charge to be switched might adversely affect the faster switching speed which is an advantage of this method of gating.

As with the embodiments which are intended to be tuned before use described above, in embodiments in which the gain-modifying wire 16 is to be used additionally or alternatively to modify the gain of the photomultiplier (but not solely to provide a gating function) during operation thereof, the gain-modifying wire is located partway along the cascade of dynodes, since it might otherwise prevent the cloud of electrons from homogenising with respect to photon events at the photocathode (if positioned too close to the photocathode) or it might degrade the pulse-height linearity (if positioned too close to the anode).

In such embodiments the gain-modifying wire is electrically connected to two electrically isolated pins which pass through the vacuum sealed envelope of the photomultiplier.

The potential required to achieve the desired modification of the gain of a multiplier is dependent upon a number of factors (particularly photomultiplier characteristics) and it may be determined experimentally.

While the embodiments shown in FIGS. 1 and 2 are linear focus type photomultipliers, the invention is equally applicable to other types of photomultipliers, such as box-and-grid, venetian blind and circular-focused photomultipliers.

Furthermore, while embodiments having only a single wire 16 have been discussed, embodiments having two or more wires may equally be provided, each wire having the same function as the single wire of the embodiments described above. Alternatively, one or more wires could be provided for increasing gain, and one or more further wires provided for reducing gain. One or more of such wires could have both functions.

By part-cylindrical (in relation to the shapes of the dynodes) is intended a shape obtainable by taking a longitudinal slice of a cylinder (whether or not having a circular cross-section). However, planar dynodes, part-spheroidal dynodes or even more irregularly curved dynodes may also be used.

While the present invention has been described in its preferred embodiments, it is to be understood that the words which have been used are words of description rather than limitation and that changes may be made to the invention without departing from its scope as defined by the appended claims.

Each feature disclosed in this specification (which term includes the claims) and/or shown in the drawings may be incorporated in the invention independently of other disclosed and/or illustrated features.

Statements in this specification of the "objects" or "aims" of the invention relate to preferred embodiments of the invention, but not necessarily to all embodiments of the invention falling within the claims.

The text of the abstract filed herewith is repeated here as part of the specification.

A photomultiplier is disclosed having an element for modifying the gain thereof either during manufacture (after the normal activation process) or in use, by changing the secondary electron emission characteristics of dynodes of the photomultiplier and/or by modifying the electromagnetic field within the photomultiplier. The gain modifying element is made of a different material to the emissive surface of the dynodes, and may reduce the gain of the photomultiplier. Methods of manufacturing a photomultiplier and of tuning the gain of a photomultiplier are also disclosed.

The invention claimed is:

1. A photomultiplier comprising an evacuated chamber containing a photocathode, a plurality of dynodes, the dynodes having a secondary electron emissive surface of a first material, and an anode, the chamber further containing a gain modifying element of a second material disposed between successive dynodes to modify the gain of the secondary electron emissive surface, the second material being different from the first material.

2. A photomultiplier according to claim 1, wherein the gain modifying element is a gain reducing element.

3. A photomultiplier according to claim 1 wherein the second material alters the secondary electron emission characteristics.

4. A photomultiplier according to claim 3, wherein the second material causes deterioration of the secondary electron emission characteristics

5. A photomultiplier according to claim 1, wherein the gain modifying material is selected from the group consisting of manganese and aluminum.

6. A photomultiplier according to claim 1, wherein the gain modifying material is selected from the group consisting of manganese and aluminum and the secondary electron emissive surfaces comprise a material selected from the group consisting of: a combination of antimony with an alkali metal; a combination of antimony with cesium; beryllium oxide; or a combination thereof.

7. A photomultiplier according to claim 1, wherein the gain modifying element comprises a wire located along a line of equipotential of the photomultiplier.

8. A photomultiplier according to claim 7, wherein the wire is located along a line which otherwise, would have the same potential as an adjacent dynode and is electrically connected to that dynode.

9. A photomultiplier according to claim 8, wherein the connection between the wire and the adjacent dynode is wholly within the evacuated chamber of the photomultiplier.

10. A photomultiplier according to claim 1 wherein the dynodes are arranged in a cascade and wherein the gain modifying element is disposed towards the middle of the dynode-cascade.

11. A photomultiplier according to claim 1 wherein the gain modifying element is electrically connected to a connector passing through the chamber.

12. A photomultiplier according to claim 11 wherein the gain modifying element is also electrically connected to a second connector passing through the chamber.

13. A photomultiplier comprising dynodes that provide secondary electron emissive surfaces after activation of the photomultiplier, and a gain modifying element providing a source of gain modifying material different from a material of the secondary electron emissive surfaces, the gain modifying element being disposed between dynodes of the photomultiplier, and the gain modifying element being arranged to be actuated after activation of the photomultiplier to cause gain modifying material to deposit onto at least one secondary electron emissive surface to modify the gain of the secondary electron emissive surfaces.

14. A batch of photomultipliers each according to claim 13 and each comprising a plurality of dynodes having an emissive surface formed of a mixture of materials the proportions of materials in the mixture being chosen such that each photomultiplier in the batch has substantially the same intrinsic gain.

15. A photomultiplier according to claim 13 wherein the gain modifying element is located along a line of equipotential of the photomultiplier.

16. A photomultiplier according to claim 13 wherein the gain modifying element is configured to pass a current.

17. A photomultiplier according to claim 13 wherein the gain modifying element is configured to pass a pulsed current.

18. A photomultiplier according to claim 13, wherein the gain modifying material reduces the gain of the dynode.

19. A photomultiplier according to claim 13, wherein the gain modifying material is selected from the group consisting of manganese and aluminum.

20. A photomultiplier according to claim 13, wherein the secondary electron emissive surfaces comprise a material selected from the group consisting of: a combination of antimony with an alkali metal; a combination of antimony with cesium; beryllium oxide; or a combination thereof.

21. A photomultiplier comprising an evacuated chamber containing a photocathode, a plurality of dynodes, the dynodes having a secondary electron emissive surface of a first material, and an anode, the chamber further containing a gain modifying element disposed between successive dynodes, the gain modifying element providing a source of a second material for deposition onto at least one said secondary electron emissive surface to modify the gain of that secondary electron emissive surface, the second material being different from the first material.

* * * * *